US005294955A

United States Patent [19]

Frank

[11] Patent Number: 5,294,955

[45] Date of Patent: Mar. 15, 1994

[54] APPARATUS AND METHOD FOR WASHING LIGHT SENSITIVE MATERIAL

[75] Inventor: Lee F. Frank, Rochester, N.Y.

[73] Assignee: Eastman Kodak Company, Rochester, N.Y.

[21] Appl. No.: 884,577

[22] Filed: May 18, 1992

[51] Int. Cl.[5] ..... G03D 3/02

[52] U.S. Cl. ..... 354/324

[58] Field of Search ..... 354/324, 298, 299, 317-324; 204/409, 406, 411, 416

[56] References Cited

U.S. PATENT DOCUMENTS

| | | | |
|---|---|---|---|
| 4,505,565 | 3/1985 | Tanaka | 354/299 |
| 4,577,948 | 3/1986 | Lawson et al. | 354/299 |
| 4,796,042 | 1/1989 | Mappin et al. | 354/324 |
| 4,966,670 | 10/1990 | Calzi | 204/406 |
| 5,168,296 | 12/1992 | Nakamura et al. | 354/320 |

*Primary Examiner*—D. Rutledge

*Attorney, Agent, or Firm*—Dana M. Schmidt

[57] ABSTRACT

In the replenishment of a washing fluid with a replenishment fluid a chemical property of the replenishment fluid is compared to the chemical property of the washing fluid. Replenishment fluid is added to the washing fluid according to the difference in the properties of the washing fluid and replenishment fluid.

12 Claims, 6 Drawing Sheets

APPARATUS AND METHOD FOR WASHING LIGHT SENSITIVE MATERIAL

TECHNICAL FIELD

This invention relates to the processing of light sensitive material and more specifically to apparatus and methods for washing such material during processing.

BACKGROUND ART

During processing of the light sensitive material it is necessary to wash the material after a chemical treatment to remove chemical ingredients used in the treatment. Such washing is generally carried out by transporting the light sensitive material through a wash chamber containing water supplied from a domestic water source. Means are generally provided to periodically or continuously replenish the wash water to avoid the build up of contaminants such as salts in the wash water. However, it is desirable to minimize replenishment to reduce water consumption and waste water discharge.

One of the problems in hard or saline water regions is that the fresh water itself contains salts. If an ionic conductivity sensor is used to regulate the amount of water replenishment during the washing process, the presence of such salts can result in a false identification of the residual salts in the water from the washing function. This is because ionic conductivity sensors do not distinguish between different ions well. Thus it is difficult to determine the concentrations of salts in the fresh water relative to that produced by the washing process to accurately control water replenishment to achieve water conservation.

DISCLOSURE OF THE INVENTION

It is an object of the present invention to monitor a chemical property of incoming wash water during a washing process to accurately determine the change in the chemical property produced by the washing process.

Another object of the invention is to measure the ionic conductivity of incoming wash water to establish a reference level for use in measuring the change in conductivity of the wash water resulting from the washing process.

In accordance with a preferred embodiment of the invention a sensor for measuring a chemical property is initially flooded with incoming water to establish a reference level for the chemical property. Thereafter the sensor is exposed to mixed wash water to measure its chemical property relative to the reference level. The wash water is replenished in accordance with the difference in chemical properties.

BRIEF DESCRIPTION OF THE DRAWINGS

Other objects and advantages will become apparent from the following description presented in connection with the accompanying drawings wherein.

MODE OF CARRYING OUT THE INVENTION

Figure 1:
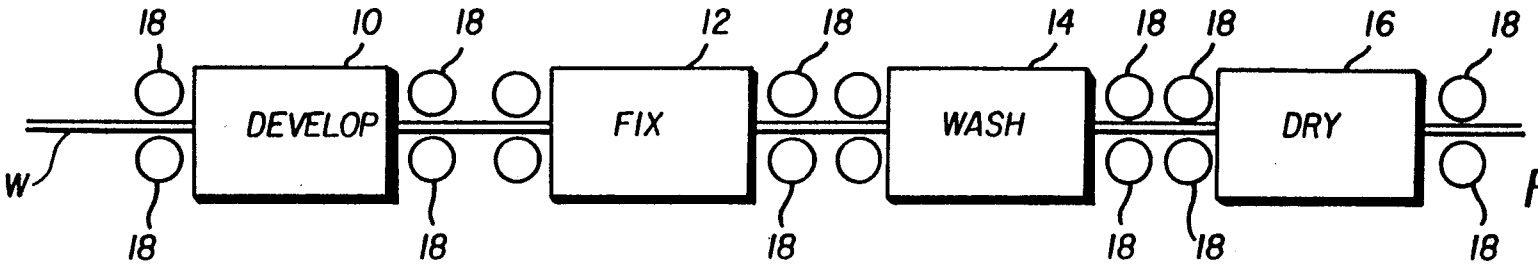
FIG. 1 is a block diagram of a typical prior art processing system.

Referring to FIG. 1 of the drawings there is shown a typical system for processing web material such as photographic film or paper. In general such a system includes a series of processing stations 10, 12 and 14 containing developing, fixing and washing solutions respectively for processing a web W of light sensitive film or paper. A final drying station 20 serves to dry the web exited from the wash station. A plurality of rollers 18 may be provided to transport the web through the various stations.

Figure 2:
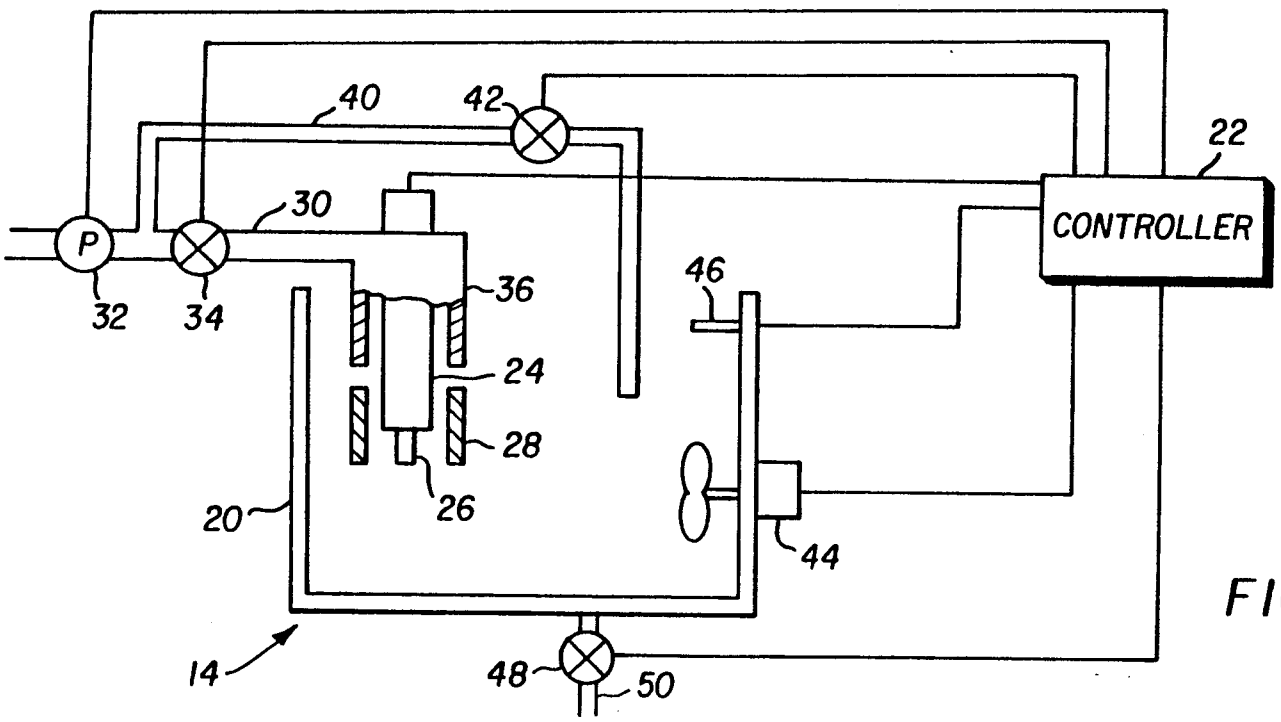
FIG. 2 is a schematic illustration of a preferred embodiment of washing apparatus in accordance with the invention.

Referring now to FIG. 2 of the drawings there is shown apparatus for controlling the replenishment of wash water in the washing station 14. The parts for transporting the film internally through the station form no part of the present invention and have been omitted to simply the disclosure. Also the parts of the replenishment apparatus have been exaggerated in size to facilitate an understanding of the invention.

The apparatus depicted in FIG. 2 includes a tank 20 having an interior chamber for washing solution (in this case water) for washing the web as it is transported through the chamber.

The replenishment apparatus includes a central controller or general purpose computer 22 which may be programmed to implement the operating sequence described below in a manner well known to those skilled in the art.

The system hardware includes a generally cylindrical ionic conductivity sensor 24 supported within the tank 20 to sense the conductivity of the water in the vicinity of a cylindrical probe element 26. The probe element 26 is encircled by a cylindrical spaced baffle 28. A main inlet conduit or pipe 30 supplies fresh water to the tank 20 from a water supply. A pump 32 controlled by controller 22 may be provided to provide a desired water inlet pressure and a solenoid valve 34 also controlled by controller 22 may be provided to turn the water supply on and off as described below.

Inlet conduit 30 is connected to a water discharge fitting 36 within the tank 20. More specifically the fitting 36 is cylindrical in configuration and surrounds the sensor 24 in spaced coaxial relationship therewith so as to discharge water axially along the periphery of the sensor 24 and probe 26 into the area between the baffle 28 and probe 26.

Figure 7:
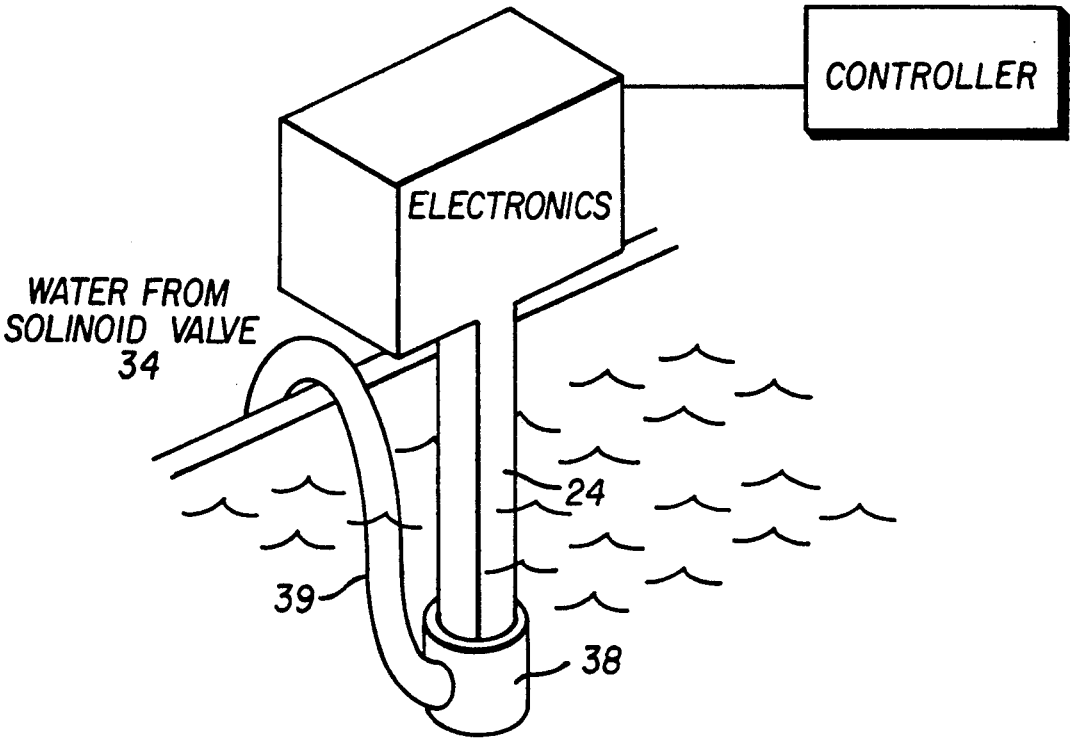
FIG. 7 is a schematic illustration of a preferred embodiment of the sensor head and water inlet.

In FIG. 7 there is shown an alternative and preferred embodiment of the sensor 24 and water inlet. In this case the sensor 24 is received in a cylindrical fitting 38 which is supplied with water from the solenoid valve 34 by a conduit 39. In this embodiment fresh water purges wash solution from the sensor head when the valve 34 is open. Active circulation in the tank 20 purges fresh water quickly from the sensor when the valve 34 is closed.

The apparatus also includes a water replenishment means comprising a conduit 40 connected to the conduit 30 between the pump 32 and valve 34 and extending into the tank 20 at a location spaced from the discharge fitting 36 and probe 24. A replenishment valve 42 controlled by controller 22 may be energized to supply replenishment water to the tank as described below.

The apparatus also includes pump 44 for circulating water within the tank 20, a level detector 46 for detecting the level of water within the tank 20, and a solenoid valve 48 for controlling the discharge of water from the tank through a waste conduit 50.

Figure 3:
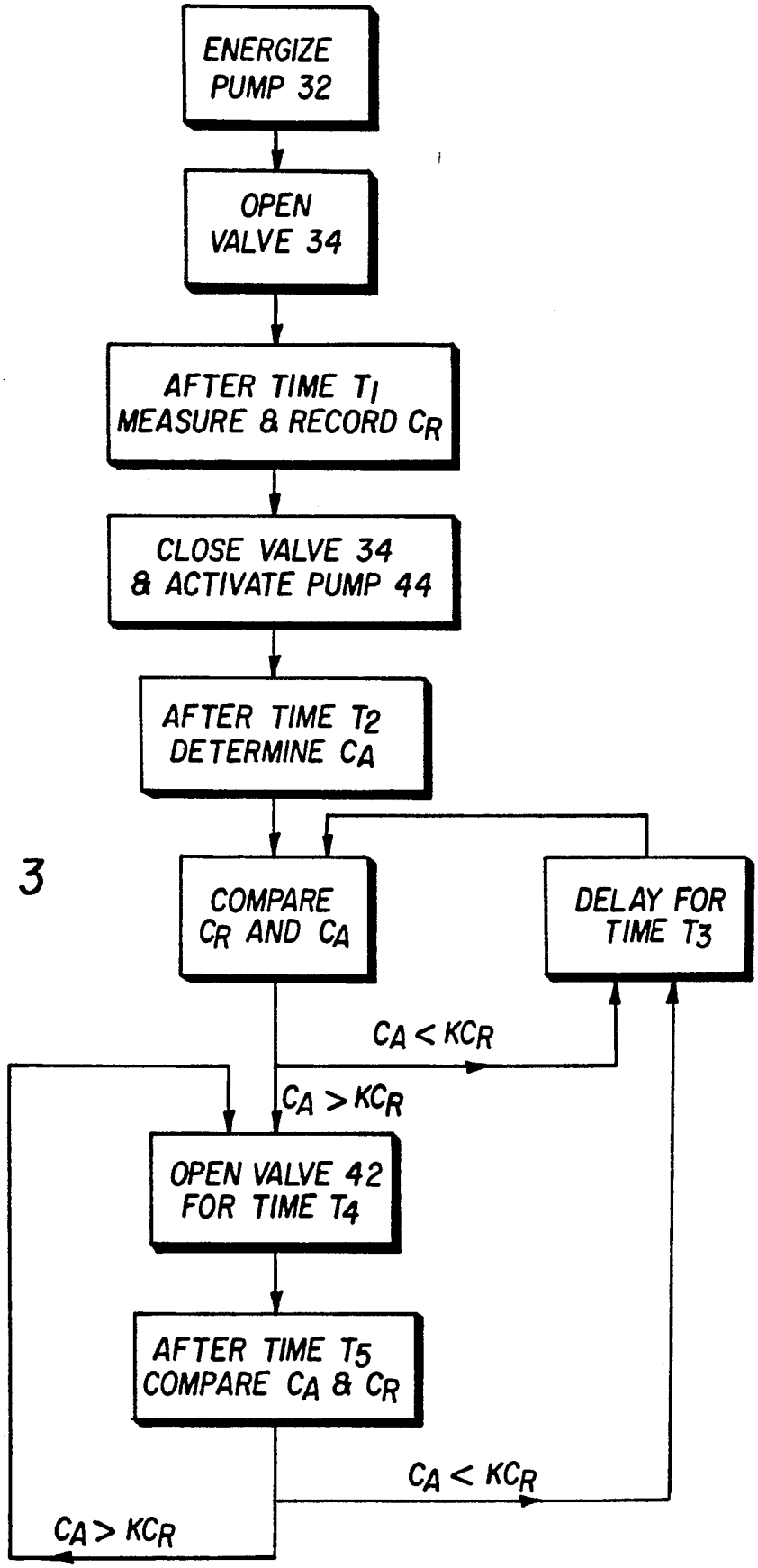
FIG. 3 is a flow diagram illustrating the operating routine of the apparatus shown in FIG. 2.

Referring now to the operation of the system depicted in FIG. 2 reference is made to FIG. 3 which is a flow diagram illustrating the operating sequence of the system beginning with start up. As indicated in FIG. 3 pump 32 will be initially energized by controller 22 to pressurize the water conduits 30 and 40. Next valve 34 will be opened by controller 32 to supply water to water discharge fitting 36 and thereby flood sensor 36 and probe 26 with incoming fresh water. After a time $T_1$ sufficient for the sensor output to stabilize the controller 22 will measure and record the ionic conductivity in a nonvolatile memory as a conductivity reference value $C_R$. After establishment of $C_R$ the valve 34 will be closed by the controller 22. Pump 44 will be energized to circulate liquid within the tank 20 to mix the fresh water injected via conduit 30 with the existing water.

The system will now continuously monitor the conductivity of the wash water in reference to the reference conductivity $C_R$ as follows. As indicated in FIG. 3 after time $T_2$ controller 22 will monitor the output of sensor 24 to establish $C_A$, the actual conductivity value of the mixed wash water. Controller 22 will compare $C_R$ and $C_A$ to determine whether a conductivity difference exists. As indicated in FIG. 3 if $C_A$ is less than $KC_R$, where K is a constant representing a tolerable difference in conductivity then controller 22 after a time delay $T_3$ will repeat the comparison. The system will stay in this loop until $C_A$ exceeds $KC_R$ whereupon controller 22 will open valve 42 for a time $T_4$ to supply a quantity of fresh water to tank 20 via conduit 40. After a further time delay $T_5$ to allow for mixing of the injected water, controller 22 will again compare $C_A$ and $C_R$. If $C_A$ is less than $KC_R$ the system will cycle into the previous loop to repeat the measurement and comparison process after time $T_3$. On the other hand if $C_A$ is greater than $KC_R$ then valve 42 will be opened again for time $T_4$ and the replenishment and monitoring cycle will be repeated.

During the above process the controller 22 in a subroutine (not shown) will compare the water level as sensed by probe 46 and coordinate the operation of valves 42 and 48 and/or other parts to maintain a desired water level as a separate coordinated routine. Since water level control techniques are well known to those skilled in the art and form no part of the present invention further description is deemed necessary.

Figure 4:
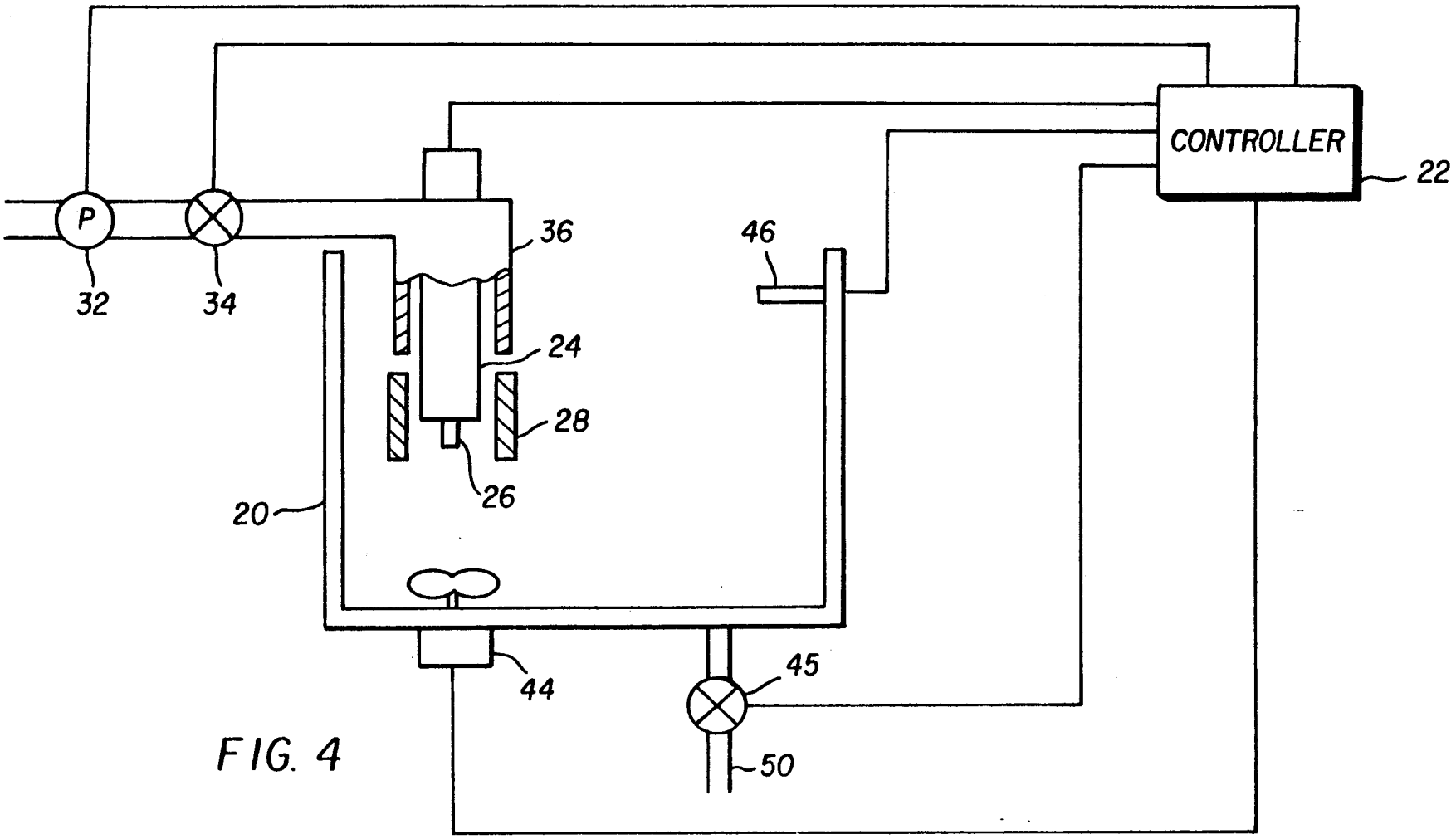
FIG. 4 is a schematic illustration similar to FIG. 2 showing another embodiment of the invention.

Referring to FIG. 4 of the drawings another embodiment of the invention is shown which utilizes only a single water inlet conduit. More specifically in the embodiment of FIG. 4 the separate replenishment conduit 40 of FIG. 2 is omitted. The initial flush of the sensor 24 with fresh water is accomplished in the same manner but the circulation of the wash water is enhanced and system functions are timed so that replenishment water can also be supplied through discharge fitting 36. In this case circulating pump 44 will be located to more directly distribute water from the region of sensor 24 so that fresh water is more rapidly mixed with existing water in the region of the sensor.

Figure 5:
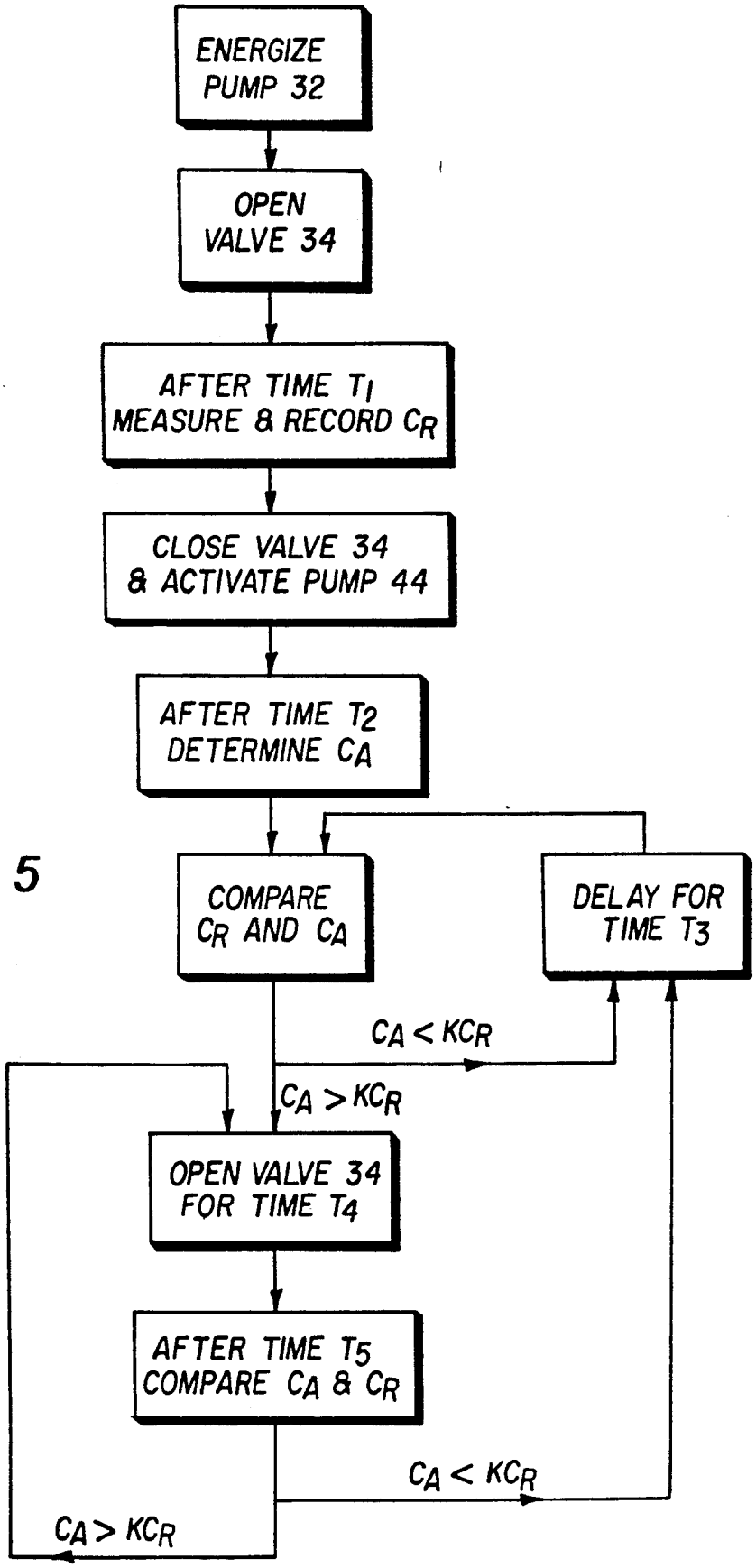
FIG. 5 is a flow diagram illustrating the operating routine of the embodiment shown in FIG. 4.

Referring to the operating routine depicted in FIG. 5, at start up controller 22 initially energizes pump 32 to pressurize the inlet conduit 30. Valve 34 will then be opened to flood sensor 24 with fresh water. After time $T_1$ the ionic conductivity reference value $C_R$ of the incoming water will be measured and recorded in the memory of controller 22. Valve 34 will now be closed by controller 22 and the circulation pump 44 will be energized to circulate water through the region of sensor 24 and thoroughly mix the new water with the existing water in tank 20. After a time delay $T_2$ sufficient to insure such mixing, controller 22 will measure the actual conductivity $C_A$. Similar to the FIG. 2 embodiment $C_A$ and $C_R$ will now be compared. If $C_A$ is less than $KC_R$ controller 22 will measure $C_A$ again after tie delay $T_3$. If $C_A$ is greater than $KC_R$ valve 34 will be opened to add fresh water to the tank 20 for time $T_4$. After time $T_5$, $C_A$ and $C_R$ will be compared again. If $C_A$ is less than $KC_R$ then original time delay $T_3$ and comparison of $C_R$ and $C_A$ will be repeated. However if $C_A$ is greater than $KC_R$ then valve 34 will be opened again for time $T_4$ as indicated in FIG. 5 whereupon the comparison and replenishment cycle will be repeated.

It will be apparent that in the FIG. 5 embodiment the time periods $T_2$, $T_3$ and $T_5$ may be longer time periods than for the FIG. 2 embodiments to allow more time for stabilization of the wash water.

Figure 6:
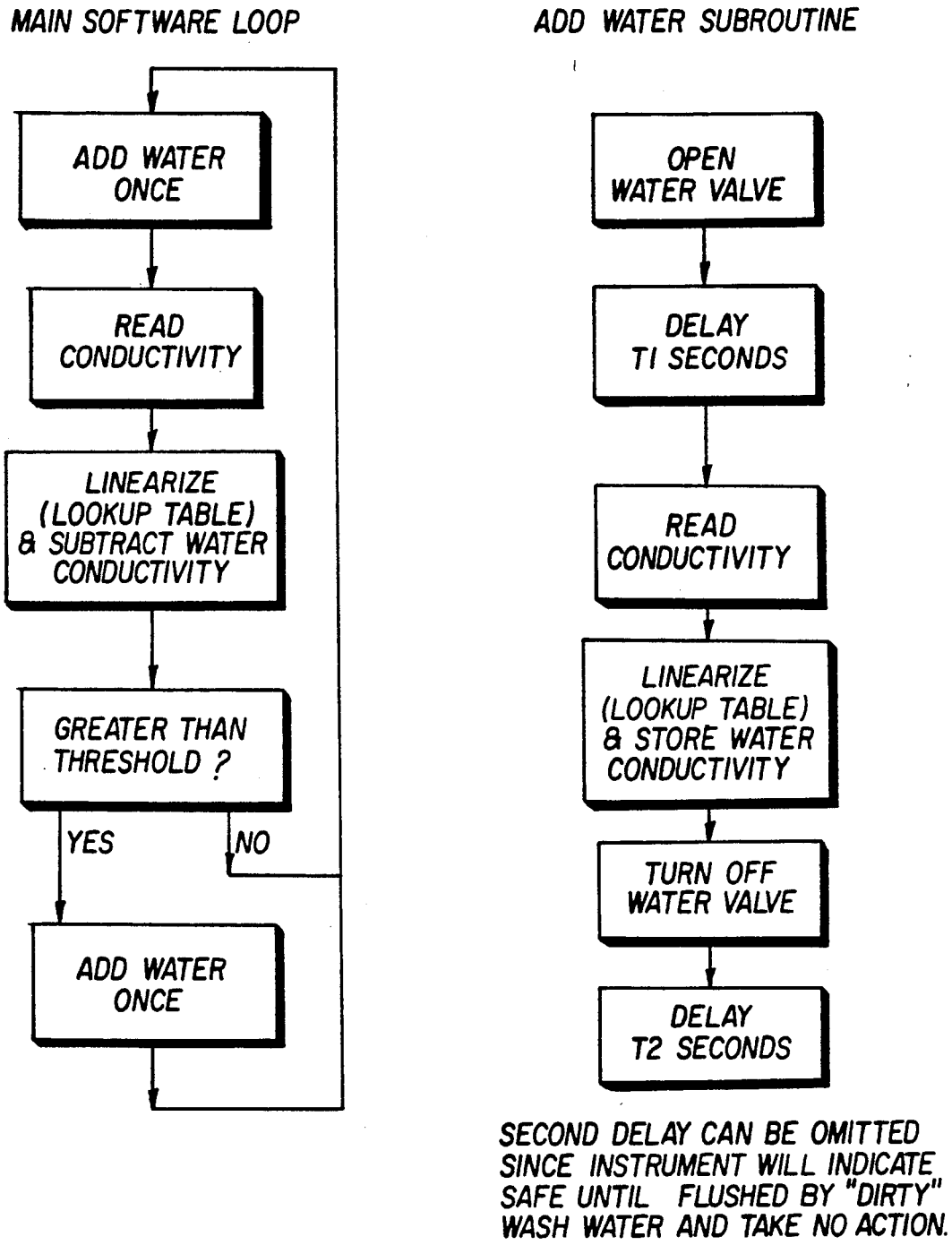
FIG. 6 is a flow diagram illustrating an alternative operating routine for the embodiments of FIGS. 2 and 4.

Referring to FIG. 6 of the drawings there is shown a simplified operating routine which is applicable to the embodiments shown in FIGS. 2 and 4. This embodiment includes a main software loop and an add water subroutine each of which includes a comparison with a look up table to compensate for non-linearity of the probe conductivity senser.

It will now be apparent that he disclosed embodiments of the invention provide a simple and reliable means for determining the ionic conductivity of water to be used in a washing process. The reference value established by flooding the sensor is used to determine the actual change in conductivity caused by the washing process. Replenishment is initiated based on changes from the reference level. This arrangement reduces unnecessary replenishment as would be the case if the reference level were not established. The disclosed apparatus and method thus minimize water consumption and improve the washing process.

Those skilled in the art to which the invention relates will appreciate that substitutions and modifications can be made to the disclosed embodiments without departing from the spirit and scope of the invention as defined by the appended claims.

I claim:

1. A method for washing web material with a washing fluid after a chemical treatment process and for replenishing the washing fluid, said method including the steps of:

flooding a sensor with replenishment fluid to determine the ionic conductivity of the replenishment fluid;

mixing the replenishment fluid with the washing fluid;

contacting the sensor with the washing fluid to determine the conductivity of the washing fluid;

comparing the ionic conductivity of the washing fluid with the ionic conductivity of the replenishment fluid to determine the difference in conductivity; and adding replenishment fluid to the washing fluid according to the difference in conductivity.

2. A method as claimed in claim 1 wherein the washing and replenishment fluids are water.

3. A method as claimed in claim 2 wherein the web material comprises light sensitive material.

4. A method for replenishing wash water in a chamber to maintain a chemical property of the wash water in a predetermined range relative to the same chemical property of the replenishment water, said method comprising the steps of:

A. initially flooding a sensor with replenishment water to determine the chemical property of the replenishment water;

B. circulating water within the tank;

C. determining the chemical property of the wash water within the tank;

D. comparing the chemical property of the replenishment water with the chemical property of the wash water;

E. adding a quantity of replenishment water to the chamber at a location remote from the sensor if the chemical property of the wash water is outside of the range; and repeating steps D and E as necessary until the chemical property of the wash water is in the predetermined range.

5. A method as claimed in claim 4 wherein the chemical property determined is ionic conductivity.

6. A method for replenishing wash water in a chamber to maintain a chemical property of the wash water in a predetermined range relative to the same chemical property of the replenishment water, said method comprising the steps of:

A. flooding a sensor within the chamber with replenishment water to determine the chemical property of the replenishment water;

B. terminating the flooding of the sensor;

C. circulating wash water within the chamber to mix the replenishment water used to flood the sensor with wash water in the chamber;

D. measuring the conductivity of the wash water using the sensor;

E. comparing the chemical property of the replenishment water with the chemical property of the wash water;

F. adding additional replenishment water to the chamber if the chemical property of the wash water is outside the range; and G. repeating step E and F until the conductivity of the wash water is within the predetermined range.

7. A method as claimed in claim 6 wherein the chemical property measured is ionic conductivity.

8. Apparatus for replenishing a washing solution having a variable chemical property with replenishment solution having the same variable chemical property, said apparatus comprising:

means for measuring the chemical property of the washing solution;

means for measuring the chemical property of a replenishment solution;

means for comparing the chemical property of the washing solution with the chemical property of the replenishment solution to establish a difference in chemical properties; and means for adding replenishment fluid to the washing solution according to said difference in chemical property.

9. Apparatus as claimed in claim 8 wherein the washing solution and replenishment solution comprise water and the chemical property measured comprises ionic conductivity.

10. Apparatus for replenishing a water washing solution having a variable ionic conductivity with replenishment water having a variable ionic conductivity, said apparatus comprising:

sensor means for measuring he ionic conductivity of the washing solution and the replenishment water;

means for flooding the sensor means with replenishment water to establish a reference value of ionic conductivity for the replenishment water;

means for mixing the replenishment water used to flood said sensing means with the washing solution;

means for comparing the reference value of ionic conductivity with the ionic conductivity of the washing solution; and means for adding replenishment water to the washing solution to maintain the ionic conductivity of the washing solution in a predetermined range.

11. Apparatus as claimed in claim 10 wherein the replenishment water adding means injects water into the wash solution at a location spaced from said sensing means.

12. Apparatus for replenishing a water washing solution having a variable ionic conductivity with replenishment water having a variable ionic conductivity, said apparatus comprising:

sensor means for measuring the conductivity of the washing solution;

activatable means for injecting the replenishment water into the solution in the vicinity of the sensor;

means for activating said injecting means to initially inject a quantity of replenishment water into the solution to cause said sensing means to initially measure the ionic conductivity of the replenishment water to establish a reference value of ionic conductivity;

means for circulating the washing solution after such initial injection of replenishment water;

means for periodically comparing said reference value with the ionic conductivity of the solution to establish a difference in ionic conductivity; and means responsive to said conductivity difference for adding additional replenishment water to the washing solution to maintain the ionic conductivity of the washing solution in a predetermined range relative to said reference conductivity.

* * * * *